US009256206B2

(12) United States Patent
Hessler et al.

(10) Patent No.: US 9,256,206 B2
(45) Date of Patent: Feb. 9, 2016

(54) DEVICE FOR MAINTAINING AND REGULATING A TIMEPIECE RESONATOR

(71) Applicant: The Swatch Group Research and Development Ltd, Marin (CH)

(72) Inventors: Thierry Hessler, St-Aubin (CH); Davide Sarchi, Renens (CH); Marc Stranczl, Nyon (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/620,660

(22) Filed: Feb. 12, 2015

(65) Prior Publication Data

US 2015/0234353 A1 Aug. 20, 2015

(30) Foreign Application Priority Data

Feb. 17, 2014 (EP) ..... 14155427

(51) Int. Cl.

| | |
|---|---|
| ***G04B 17/04*** | (2006.01) |
| ***G04B 17/06*** | (2006.01) |
| ***G04B 17/28*** | (2006.01) |
| ***G04B 18/02*** | (2006.01) |
| ***G04C 3/04*** | (2006.01) |

(52) U.S. Cl.

CPC ..... *G04B 17/04* (2013.01); *G04B 17/06* (2013.01); *G04B 17/28* (2013.01); *G04B 18/02* (2013.01); *G04C 3/04* (2013.01)

(58) Field of Classification Search

CPC ..... G04B 17/04; G04B 17/06; G04B 17/10; G04B 17/222; G04B 17/28; G04B 18/02; G04C 3/04; G04C 3/08

USPC ..... 368/168, 169, 170

See application file for complete search history.

(56) References Cited

U.S. PATENT DOCUMENTS

| | | | | |
|---|---|---|---|---|
| 3,736,743 | A * | 6/1973 | Koike | G04B 17/045 368/168 |
| 4,308,605 | A * | 12/1981 | Ayer | G04B 13/02 368/127 |
| 8,979,359 | B2 * | 3/2015 | Rochat | G04B 17/325 368/169 |
| 2006/0221775 | A1 * | 10/2006 | Zaugg | G04B 17/285 368/127 |

(Continued)

FOREIGN PATENT DOCUMENTS

| | | |
|---|---|---|
| CH | 615 314 | 1/1980 |
| DE | 1 217 883 | 5/1966 |

(Continued)

OTHER PUBLICATIONS

European Search Report issued Nov. 28, 2014 in European Application 14155427, filed on Feb. 17, 2014 ( with English Translation).

*Primary Examiner* — Vit W Miska

(74) *Attorney, Agent, or Firm* — Oblon, McClelland, Maier & Neustadt, L.L.P.

(57) ABSTRACT

Timepiece resonator oscillating at a natural frequency, comprising one oscillating member and oscillation maintenance means, this oscillating member carrying a regulator oscillating at a regulation frequency comprised between 0.9 times and 1.1 times the value of an integer multiple greater than or equal to 2 of the natural frequency, this resonator is included in a timepiece movement for a timepiece, particularly a watch, and this regulator imposes a periodic modulation of the resonant frequency and/or quality factor and/or point of rest of this resonator.

25 Claims, 6 Drawing Sheets

(56) References Cited

U.S. PATENT DOCUMENTS

| | | | | |
|---|---|---|---|---|
| 2007/0079657 | A1 | 4/2007 | Moteki et al. | |
| 2010/0283556 | A1 | 11/2010 | Hessler et al. | |
| 2011/0096636 | A1* | 4/2011 | Pellet ..... | G04B 17/06 368/127 |
| 2012/0207001 | A1 | 8/2012 | Pittet et al. | |

FOREIGN PATENT DOCUMENTS

| | | | |
|---|---|---|---|
| EP | 1 772 791 | A1 | 4/2007 |
| EP | 1 843 227 | A1 | 10/2007 |
| EP | 1 772 791 | B1 | 3/2008 |
| EP | 2 487 547 | A1 | 8/2012 |
| EP | 2 690 507 | A1 | 1/2014 |

* cited by examiner

DEVICE FOR MAINTAINING AND REGULATING A TIMEPIECE RESONATOR

This application claims priority from European patent application No. 14155427.9 filed Feb. 17, 2014, the entire disclosure of which is hereby incorporated herein by reference.

FIELD OF THE INVENTION

The invention concerns a forced oscillation timepiece resonator mechanism arranged to oscillate at a natural frequency and comprising, on the one hand, at least one oscillating member, and on the other hand, means for maintaining the oscillations arranged to exert an impact and/or a force and/or a torque on said oscillating member, wherein said oscillating member carries at least one oscillating regulator device whose natural frequency is a regulation frequency that is comprised between 0.9 times and 1.1 times the value of an integer multiple of the natural frequency of said resonator mechanism, said integer being greater than or equal to 2 and less than or equal to 10.

The invention also concerns a timepiece movement comprising at least one resonator mechanism arranged to oscillate around its natural frequency.

The invention also concerns a timepiece, particularly a watch, including at least one such movement.

The invention concerns the field of time bases in mechanical watchmaking.

BACKGROUND OF THE INVENTION

The search for improvements in the performance of timepiece time bases is a constant preoccupation.

A significant limitation on the chronometric performance of mechanical watches lies in the use of conventional impulse escapements, and no escapement solution has ever been able to avoid this type of interference.

EP Patent Application No 1843227A1 in the name of SWATCH GROUP RESEARCH & DEVELOPMENT Ltd discloses a coupled resonator with a first low frequency resonator and a second higher frequency resonator comprising means for permanently coupling the resonators to each other.

CH Patent No 615314A3 in the name of PATEK PHILIPPE discloses a movable assembly comprising an oscillating balance, subjected to the action of a balance spring, and synchronised by a vibrating member magnetically coupled to a fixed member. The vibration frequency of this vibrating member is higher than that of the balance. The balance and the vibrating member form the same, single, movable element which simultaneously vibrates and oscillates. The vibration frequency of the vibrating member is an integer multiple of the oscillation frequency of the balance.

EP Patent Application No 2690507A1 in the name of NIVAROX discloses a timepiece assembly comprising a balance spring stud including means of attachment to a plate or to a bridge. This assembly includes a balance spring with at least one strand wound into coils between an inner end and an outer end, the inner end fixed to a collet is pivotally movable about a pivot axis, and the outer end is integral with the balance spring stud. This stud and/or collet includes braking means arranged to cooperate with at least a first coil when accelerations during the contraction or extension of the balance spring are greater than desired values, to change the resulting rigidity of the balance spring when the number of its active coils are modified by local coupling of at least the first coil to the braking means.

DE Patent No 1217883B in the name of BAEHNI & CO discloses an electric timepiece with an incremental encoder and a member for driving the gear train, using a magnetostrictive vibrator.

EP Patent Application No 2487547A1 in the name of MONTRES BREGUET SA discloses a timepiece regulator, for an escapement mechanism or striking work, with centrifugal and eddy current regulation.

EP Patent Application No 1772791A1 in the name of SEIKO EPSON concerns centrifugal regulation combined with regulation by modulation of air friction, and discloses a contactless regulator using the resistance of the viscosity of a fluid, with a rotor powered by a power transfer means, and a wing having surfaces perpendicular to the axis of rotation of the rotor, arranged on the external circumference of the rotor, and which is radially movable under the effect of the centrifugal force produced by rotation of the rotor. The wing is returned by an elastic return means. A surface opposite the circumference of the rotor is the origin of a resistance dependent on the amount of motion applied to the wing.

SUMMARY OF THE INVENTION

The invention proposes to manufacture a time base that is as accurate as possible.

To this end, the invention concerns a forced oscillation timepiece resonator mechanism arranged to oscillate at a natural frequency and comprising, on the one hand, at least one oscillating member, and on the other hand, means for maintaining the oscillations arranged to exert an impact and/or a force and/or a torque on said oscillating member, wherein said oscillating member carries at least one oscillating regulator device whose natural frequency is a regulation frequency which is comprised between 0.9 times and 1.1 times the value of an integer multiple of the natural frequency of said resonator mechanism, said integer being greater than or equal to 2 and less than or equal to 10, characterized in that said regulator device includes, loosely pivotally mounted on said oscillating member, at least one secondary sprung balance with an eccentric unbalance relative to the secondary pivot axis about which said secondary sprung spring pivots.

According to a feature of the invention, said regulator device includes at least one spring-inertia block assembly comprising an inertia block attached by a spring at a point on said oscillating member.

According to a feature of the invention, said regulator device includes at least one wing or strip that is movable under the effect of aerodynamic variations and attached by a pivot or by an elastic strip or by an arm to said oscillating member.

The invention further concerns a timepiece movement including at least one resonator mechanism arranged to oscillate about its natural frequency, characterized in that said movement includes at least one regulator device comprising means arranged to act on said resonator mechanism by imposing a periodic modulation of the resonant frequency and/or quality factor and/or point of rest of said resonator mechanism with a regulation frequency which is comprised between 0.9 times and 1.1 times the value of an integer multiple of the natural frequency of said resonator mechanism, said integer being greater than or equal to 2 and less than or equal to 10.

According to a feature of the invention, said movement includes at least one such resonator mechanism, whose oscillating member carries at least one said regulator device.

According to a feature of the invention, said movement includes at least one said regulator device distinct from a said at least one resonator mechanism, and which acts either by contact with at least one component of said resonator mechanism, or remote from said resonator mechanism by modulation of an aerodynamic flow or of a magnetic field or of an electrostatic field or of an electromagnetic field.

The invention also concerns a timepiece, particularly a watch, including at least one such movement.

BRIEF DESCRIPTION OF THE DRAWINGS

Other features and advantages of the invention will appear upon reading the following detailed description, made with reference to the annexed drawings, partially and schematically showing parametric oscillators corresponding to various implementation modes and variants of the invention, and wherein.

DETAILED DESCRIPTION OF PREFERRED EMBODIMENTS

Figure 1:
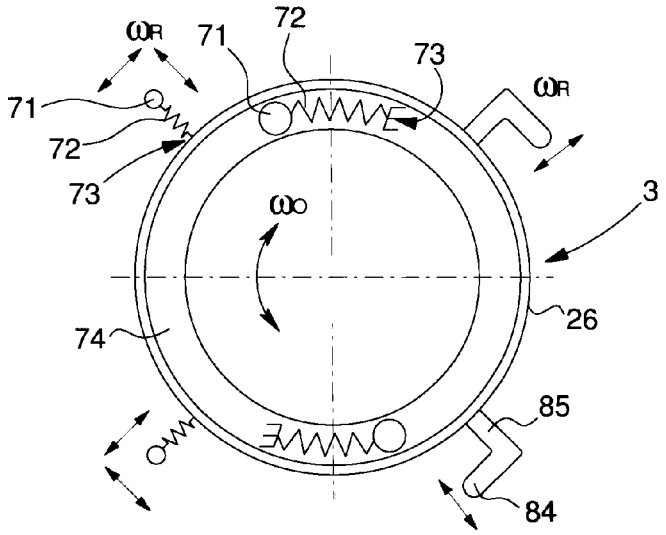
FIG. 1 shows, a schematic, partial plan view of a parametric resonator mechanism regulated according to the invention, comprising a timepiece sprung balance, forming a resonator, and whose inertia and/or quality factor is modulated by weights arranged radially or tangentially via springs and excited at a frequency double the frequency of the sprung balance resonator incorporating the balance, whose balance spring is not shown; this balance carries on its rim elements that vibrate radially or tangentially during the pivoting motion of the balance.

It is an object of the invention to produce a time base for making a timepiece, in particular a mechanical timepiece, especially a mechanical watch, as accurate as possible.

One method of achieving this consists in associating different resonators, either directly or via the escapement.

To overcome the factor of instability linked to an escapement mechanism, a parametric resonator system makes it possible to reduce the influence of the escapement mechanism and thereby render the watch more accurate.

A parametric oscillator uses, for maintaining oscillations, a parametric actuation which consists in varying at least one of the parameters of the oscillator with a regulation frequency ωR.

By convention and in order to differentiate clearly between them, "regulator" 2 refers here to the oscillator used for maintaining and regulating the other maintained system, which is referred to here as "the resonator" 1.

The Lagrangian L of a parametric resonator of dimension 1 is:

$$L=T-V=\tfrac{1}{2}I(t)\dot{x}^2-\tfrac{1}{2}k(t)[x-x_0(t)]^2$$

where T is the kinetic energy and V the potential energy, and the inertia I(t), rigidity k(t) and rest position $x_0(t)$ of said resonator are a periodic function of time, x is the generalized coordinate of the resonator.

The forced and damped parametric resonator equation is obtained via the Lagrange equation for Lagrangian L by adding a forcing function f(t) and a Langevin force taking account of the dissipative mechanisms:

$$\frac{\partial^2 x}{\partial^2 t}+\gamma(t)\frac{\partial x}{\partial t}+\omega^2(t)[x-x_0(t)]=f(t)$$

where the coefficient of the first order derivative at x is:

$$\gamma(t)=[\beta(t)+\dot{I}(t)]+I(t),$$

β(t)>0 being the terms describing losses, and where the coefficient of zero order term depends on the resonator frequency $$\omega(t)=\sqrt{k(t)/I(t)}.$$

The function f(t) takes the value 0 in the case of a non-forced oscillator.

This function f(t) may also be a periodic function, or be representative of a Dirac impulse.

The invention consists in varying, via the action of a maintenance oscillator called a regulator, one and/or the other or all of the terms β(t), k(t), I(t), $x_0(t)$, with a regulation frequency ωR that is comprised between 0.9 times and 1.1 times the value of an integer multiple, (particularly double) of the natural frequency ω0 of the oscillator system to be regulated.

To understand this phenomenon, it can be likened to the example of a pendulum whose length is varied. The damped oscillator equation is as follows:

$$\frac{\partial^2 x}{\partial^2 t}+\beta(t)\frac{\partial x}{\partial t}+\omega^2(t)[x-x_0(t)]=f(t)$$

where the first order term at x is the loss term, and where the zero order term is the frequency term of the resonator, and where $x_0(t)$ corresponds to the position of rest of the resonator.

The function f(t) takes the value 0 in the case of a non-forced oscillator.

This function f(t) may also be a periodic function, or be representative of a Dirac impulse.

The invention consists in varying, via the action of a maintenance oscillator or regulator 2, one and/or the other or all of the terms β(t), k(t), I(t), $x_0(t)$, with a regulation frequency ωR that is comprised between 0.9 times and 1.1 times the value of an integer multiple, this integer being greater than or equal to 2 and less than or equal to 10, (particularly equal to two) of the natural frequency ω0 of the oscillator system to be regulated, in this case resonator 1. In a particular application, the regulation frequency ωR is comprised between 1.8 times and 2.2 times the natural frequency ω0, and more particularly, regulation frequency ωR is double the natural frequency ω0.

Preferably, one or several terms, or all the terms β(t), k(t), I(t), $x_0(t)$ vary with a regulation frequency ωR thus defined, and which is preferably an integer multiple (particularly double) of the natural frequency ω0 of the resonator system 1 to be regulated.

Generally, in addition to modulating the parametric terms, the oscillator used for maintenance or regulation therefore introduces a non-parametric maintenance term f(t), whose amplitude is negligible once the parametric regime is attained [W. B. Case, The pumping of a swing from the standing position, Am. J. Phys. 64, 215 (1996)].

In a variant, the forcing term f(t) may be introduced by a second maintenance mechanism.

The maintenance oscillator or regulator 2 also makes it possible to vary, if it is not zero, the term f(t).

In the example of the unforced damped oscillator, and in the case where $x_0$ is a constant, the parameters of the equation are summarized by the frequency term ω and the loss term β, in particular losses through mechanical or aerodynamic or internal or other friction.

The oscillator quality factor is defined by Q=ω/β.

To better understand the phenomenon, it can be likened to the example of a pendulum whose length is varied. In such case, $$\omega^2=\frac{g}{L}$$

where L is the length of the pendulum and g the attraction of gravity.

In this particular example, if length L is modulated in time periodically with a frequency 2ω and sufficient modulation amplitude δL (δL/L>2β/ω), the system oscillates at frequency ω without damping.

In this particular example, if length L is periodically modulated in time with a frequency 2ω and sufficient modulation amplitude δL (δL/L>2β/ω), the system oscillates at frequency ω without damping.

[D. Rugar and P. Grutter, *Mechanical parametric amplification and thermomechanical noise squeezing*, PRL 67, 699 (1991), A. H. Nayfeh and D. T. Mook, Nonlinear Oscillations, Wiley-Interscience, (1977)].

The zero order term may also take the form $\omega^2(A, t)$, where A is the oscillation amplitude.

Thus, the invention concerns a method and a system for maintaining and regulating a timepiece resonator mechanism 1 around its natural frequency ω0. According to the invention, there is implemented at least one regulator device 2 acting on resonator mechanism 1 with a periodic motion.

Thus, the invention concerns a method and a system for regulating a timepiece resonator mechanism 1 around its natural frequency ω0.

According to the invention, there is implemented at least one regulator device 2 imparting a periodic motion to at least one internal component of resonator mechanism 1, or to an external component exerting an influence on such an internal component such as an aerodynamic influence or braking, or modulating a magnetic or electrostatic or electromagnetic field or similar exerting a "return" force (used in the broad sense here of attraction or repulsion) on such an internal component of resonator 1.

According to the invention, this periodic motion imposes at least a periodic modulation of the resonant frequency and/or quality factor and/or point of rest of resonator mechanism 1, with a regulation frequency ωR which is comprised between 0.9 times and 1.1 times the value of an integer multiple of natural frequency ω0, this integer being greater than or equal to 2 and less than or equal to 10.

In a first specific implementation mode of the invention, this periodic motion imposes a periodic modulation of at least the resonant frequency of resonator mechanism 1, with a regulation frequency ωR which is comprised between 0.9 times and 1.1 times the value of an integer multiple of natural frequency ω0, this integer being greater than or equal to 2 and less than or equal to 10.

In a second specific implementation mode of the invention, this periodic motion imposes a periodic modulation of at least the quality factor of resonator mechanism 1, with a regulation frequency ωR which is comprised between 0.9 times and 1.1 times the value of an integer multiple of natural frequency ω0, this integer being greater than or equal to 2 and less than or equal to 10.

In a third specific implementation mode of the invention, this periodic motion imposes a periodic modulation of at least the point of rest of resonator mechanism 1, with a regulation frequency ωR which is comprised between 0.9 times and 1.1 times the value of an integer multiple of natural frequency ω0, this integer being greater than or equal to 2 and less than or equal to 10.

Naturally, other specific implementation modes of the invention permit a mixture of the first, second and third modes.

Thus, in a fourth specific implementation mode of the invention combining the first and second modes, this periodic motion imposes a periodic modulation of at least the resonant frequency and quality factor of resonator mechanism 1, with a regulation frequency ωR which is comprised between 0.9 times and 1.1 times the value of an integer multiple of natural frequency ω0, this integer being greater than or equal to 2 and less than or equal to 10.

In a fifth specific implementation mode of the invention combining the second and third modes, this periodic motion imposes a periodic modulation of at least the quality factor and point of rest of resonator mechanism 1, with a regulation frequency ωR which is comprised between 0.9 times and 1.1 times the value of an integer multiple of natural frequency ω0, this integer being greater than or equal to 2 and less than or equal to 10.

In a sixth specific implementation mode of the invention combining the first and third modes, this periodic motion imposes a periodic modulation of at least the resonant frequency and point of rest of resonator mechanism 1, with a regulation frequency ωR which is comprised between 0.9 times and 1.1 times the value of an integer multiple of natural frequency ω0, this integer being greater than or equal to 2 and less than or equal to 10.

In a seventh specific implementation mode of the invention combining the first, second and third modes, this periodic motion imposes a periodic modulation of at least the resonant frequency, quality factor and point of rest of resonator mechanism 1, with a regulation frequency ωR which is comprised between 0.9 times and 1.1 times the value of an integer multiple of natural frequency ω0, this integer being greater than or equal to 2 and less than or equal to 10.

In a specific implementation of these various implementation modes of the method, all the modulations are performed either with the same frequency ωR or with frequencies ωR that are multiples of each other.

The first three main implementation modes of the invention will be set out in detail below.

In a specific implementation of the first implementation mode of the invention, the periodic motion imposes a periodic modulation of the resonant frequency of resonator mechanism 1 by acting on the rigidity and/or the inertia of resonator mechanism 1. More specifically, the periodic motion imposes a periodic modulation of the resonant frequency of resonator mechanism 1 by imposing both a modulation of the rigidity of resonator mechanism 1 and a modulation of the inertia of resonator mechanism 1.

Different advantageous variants permit different means of achieving the invention in this first implementation mode.

Figure 2:
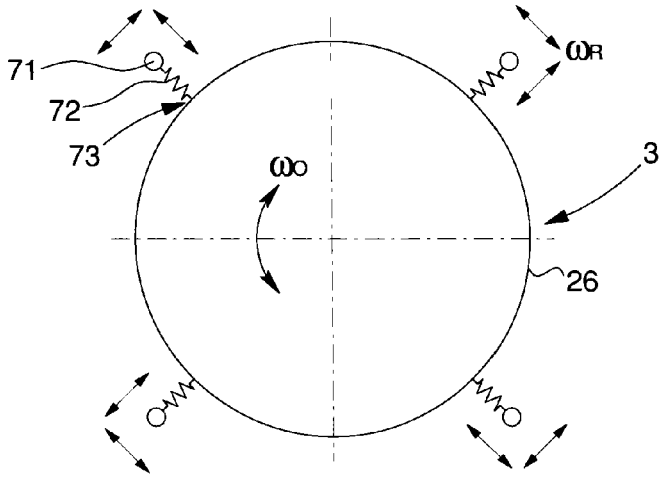
FIG. 2 shows a schematic, partial plan view of a balance comprising four radial springs connected to the rim and carrying weights, and subjected to regulating excitation at a frequency double the frequency of the sprung balance resonator incorporating the balance, whose balance spring is not shown.
Figure 3:
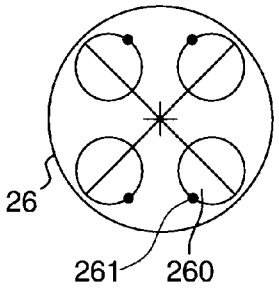
FIG. 3 shows a schematic, partial plan view of a balance carrying loosely mounted built-in sprung balances each having a high unbalance.
Figure 4:
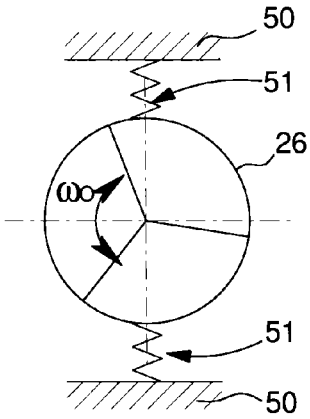
FIG. 4 shows a schematic, partial plan view of a balance suspended by two diametrically opposite radial springs, the trajectory of the centre of gravity of the balance corresponding to the common direction of the two springs.

In a first variant of the first implementation mode, this periodic motion imposes a periodic modulation of the resonator frequency of resonator mechanism 1, by imposing a modulation of the inertia of resonator mechanism 1 through modulation of the mass of resonator mechanism 1, and/or through modulation of the shape of resonator mechanism 1 (as seen in FIG. 1, 2 or 3), and/or through modulation of the position of the centre of gravity of resonator mechanism 1 as seen, for example, in the sketch of FIG. 4.

Figure 16A:
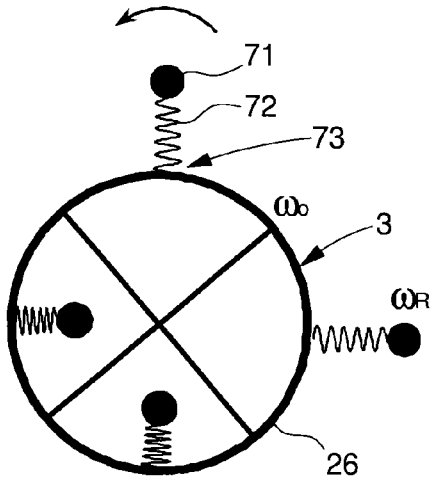
FIGS. 16A and 16B illustrate modification of the centre of gravity of the resonator, with a sprung balance resonator comprising a balance carrying substantially radial springs attached to the rim and carrying oscillating inertia blocks, some towards the interior and some towards the exterior of the rim.
Figure 16B:
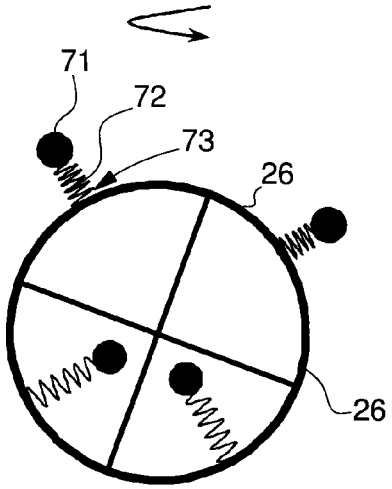

Still in this first variant of the first mode, FIGS. 16A and 16B also illustrate a modification of the centre of gravity of the resonator, and of its inertia.

Figure 7:
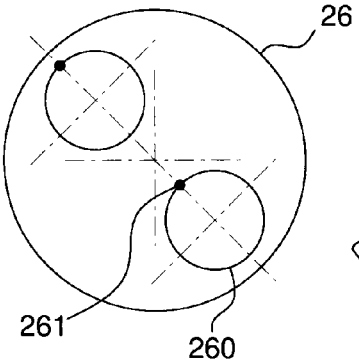
FIG. 7 shows a similar balance to that of FIG. 3 with two sprung balances with high unbalances, loosely mounted on the same diameter and in a position of alignment of the unbalances (at the point of rest), which are different from those of FIG. 3 and either in in-phase or anti-phase vibration.

Still in this first variant of the first mode, FIGS. 18A to 18D illustrate a modulation of the centre of gravity, based on a resonator like that of FIG. 3 or of FIG. 7. A system of this type includes secondary in-built sprung balances 260. These secondary sprung balances 260 are advantageously replaced by systems with no arbors, i.e. with flexible guiding, which is easier to achieve given that their amplitude of oscillation is not necessarily high. In that case, only the inertia of the main sprung balance is modified. Depending on the angular position of the unbalances of the small sprung balances, it is therefore possible to create a system whose centre of gravity is modulated.

This modulation of the centre of gravity position is preferably a dynamic modulation acting on one or more of the components of resonator 1. Inertia modulation can be achieved through shape modulation, through a change in mass, or through a change in the centre of gravity of the resonator relative to its centre of rotation, for example with the use of a flexible balance. It is also possible to use built-in resonators, with a dissymmetry having a suitable phase ratio, as seen in FIG. 7, where the unbalances are either in phase or in anti-phase vibration.

Figure 11:
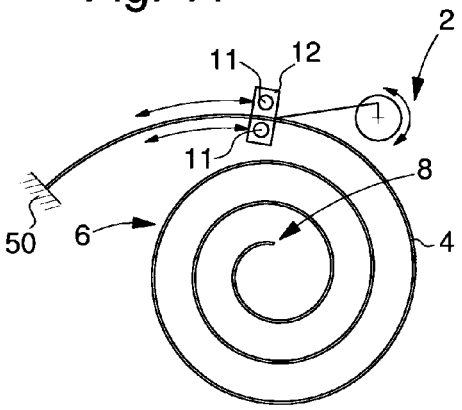
FIG. 11 shows a schematic view of a balance spring provided with an index mechanism with pins, with a crank rod system for actuating a continuous motion of the index, for a continuous variation in the active length of the balance spring.
Figure 12:
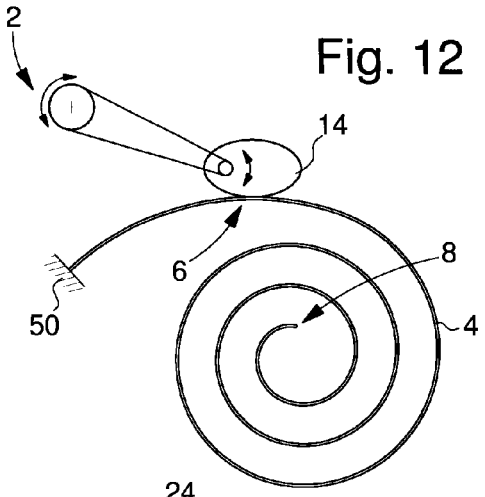
FIG. 12 shows a schematic view of a balance spring on which a cam rests, for a continuous variation in the active length of the balance spring and/or in the position of the point of attachment and/or in the geometry of the balance spring. This Figure is a simplified representation wherein a single cam rests on the balance spring on only one side; it is evidently possible to combine two cams arranged to clamp the balance spring on both sides.
Figure 13:
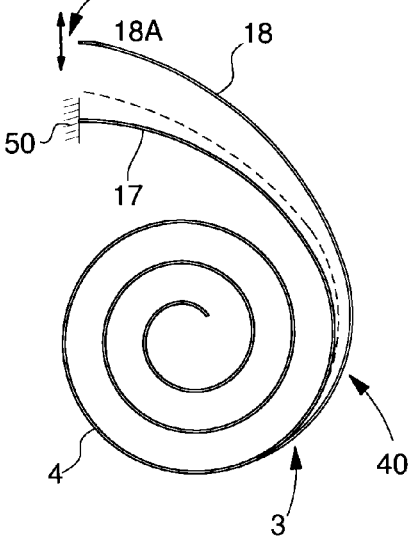
FIG. 13 shows a partial, schematic view of the balance spring of a sprung-balance assembly, with an additional coil fixed to the balance-spring and locally lining the outer terminal curve of the balance spring, and a regulator device actuating one end of this additional coil.
Figure 14:
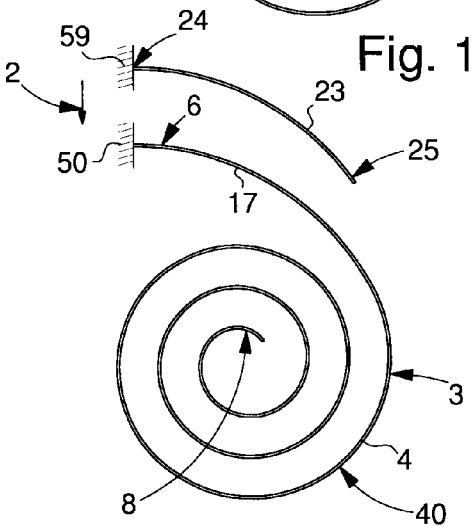
FIG. 14 illustrates a balance spring with, in proximity to its terminal curve, another coil which is held at a first end by a support operated by a regulator device, and which is free at a second end arranged to periodically come into contact with the terminal curve under the action of the regulator device on this support.

In a second variant of the first mode, this periodic motion imposes a periodic modulation of the resonant frequency of resonator mechanism 1, by imposing a modulation of the rigidity of an elastic return means comprised in resonator mechanism 1 or a modulation of a return force exerted by a magnetic or electrostatic or electromagnetic field within resonator mechanism 1. More specifically, in this second variant, the periodic motion imposes a periodic modulation of the resonant frequency of resonator mechanism 1, by imposing a modulation of the active length of a spring comprised in resonator mechanism 1 (as seen in FIGS. 11 and 12), or a modulation of the cross-section of a spring comprised in resonator mechanism 1 (as seen in FIGS. 13 and 14), or a modulation of the modulus of elasticity of a return means comprised in resonator mechanism 1, or a modulation of the shape of a return means comprised in resonator mechanism 1. The modulation of the modulus of elasticity of a component of resonator 1 can be obtained by implementing a piezoelectric system, an electrical field (electrodes), by periodic localised heating, by the action of a magnetic field subjecting specific alloys to expansion, by optomechanical resonant systems, by torsion or by twisting, in particular for shape memory materials.

In a third variant of the first mode resulting from a combination with the third implementation mode of the invention, the periodic motion imposes a periodic modulation of the resonant frequency of resonator mechanism 1 by imposing both a modulation of the rigidity of resonator mechanism 1 and a modulation of the point of rest of resonator mechanism 1.

To act on the rigidity, the phenomena of magnetostriction can advantageously be used, periodically modifying rigidity by subjecting a component, made of a suitable material, of resonator 1 to a magnetic field (internal magnetisation and/or external field), or to shocks.

To act on the modulus of elasticity, it is also possible to use the phenomenon of magnetostriction, but also to employ a periodic temperature rise, shape memory components, the piezoelectric effect, or non-linear regimes achieved through the use of specific stresses.

Figure 6:
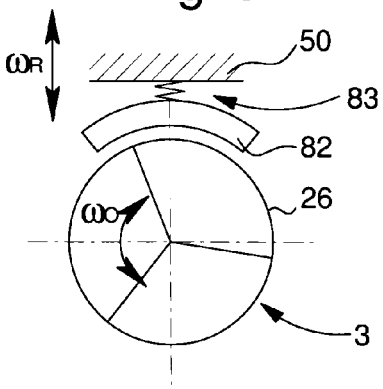
FIG. 6 shows a schematic, partial plan view of a balance in proximity to which an aerodynamic brake pad is movable at a frequency double that of the sprung balance resonator incorporating the balance, whose balance spring is not shown.
Figure 8:
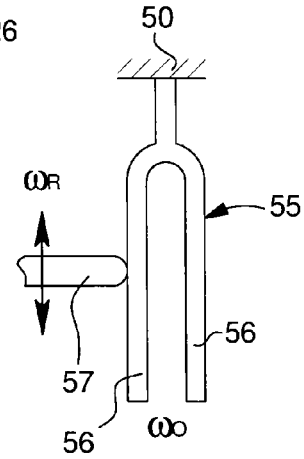
FIG. 8 shows a schematic, partial plan view of a tuning fork, one arm of which is in contact with a friction pad excited at double the frequency of the frequency of the tuning fork resonator.

In a specific implementation of the second implementation mode of the invention, this periodic motion imposes a periodic modulation of the quality factor of resonator mechanism 1 by acting on the losses and/or the damping and/or the friction of resonator mechanism 1. Action may be taken in different ways:

- in a first variant of this second mode, the periodic motion imposes a periodic modulation of the quality factor of resonator mechanism 1, by acting on the aerodynamic losses of resonator mechanism 1, through shape modulation of resonator mechanism 1 (as seen in FIG. 5 on a balance provided with pivoting wings, or in FIG. 17), and/or through modification of the environment around resonator mechanism 1 (as seen in FIG. 6 where a pad moved by a periodic motion modifies the flow of air around the balance);
- in a second variant of this second mode, the periodic motion imposes a periodic modulation of the quality factor of resonator mechanism 1 by modulating the internal damping of the elastic return means comprised in resonator mechanism 1, for example with a flow of liquid in a hollow body (for example the balance spring or balance of a sprung balance assembly), or under the effect of a torsion periodically applied to a balance spring or similar, resulting in modifications both in the rigidity and the damping of the resonator containing the spring. In a specific case, internal losses can be modified, without modifying rigidity: two springs replace a single spring with overall equivalent rigidity, the internal losses are then higher; two springs can, in particular, be placed in series, or in parallel according to the case, and one of the springs may be prestressed. Another means of modifying losses while maintaining the same rigidity is to use temperature compensation on a spring (through silicon doping or through oxidation). A thermoelastic effect can also be utilised with a heat transfer between two different parts of the coil of a spring, this thermoelastic effect may also be affected by the doping level.
- in a third variant of this second mode, the periodic motion imposes a periodic modulation of the quality factor of resonator mechanism 1, by modulating mechanical friction within resonator mechanism 1 with a similar effect to a virtual increase in gravity. FIG. 8 shows an example where a friction strip cooperates, in a modulated manner, with a tuning fork arm.

In a specific implementation of the third mode of the invention, this periodic motion imposes a periodic modulation of the point of rest of resonator mechanism 1, by modulating the position of attachment of resonator mechanism 1 and/or by modulating the equilibrium between the return forces acting on resonator mechanism 1. Modulation of the position of attachment of resonator mechanism 1 can be performed on at least one point of attachment of resonator 1. For example, in a resonator 1 with a sprung balance 3, it is possible to act on the balance spring stud and/or on the collet 7 for attaching balance spring 4 on at least one pivot point by action on the pivot shock absorber elements. Some functions of the movement can be used for this purpose, for example in a conventional escapement mechanism, the percussion of the lever on springs or suchlike.

Figure 10:
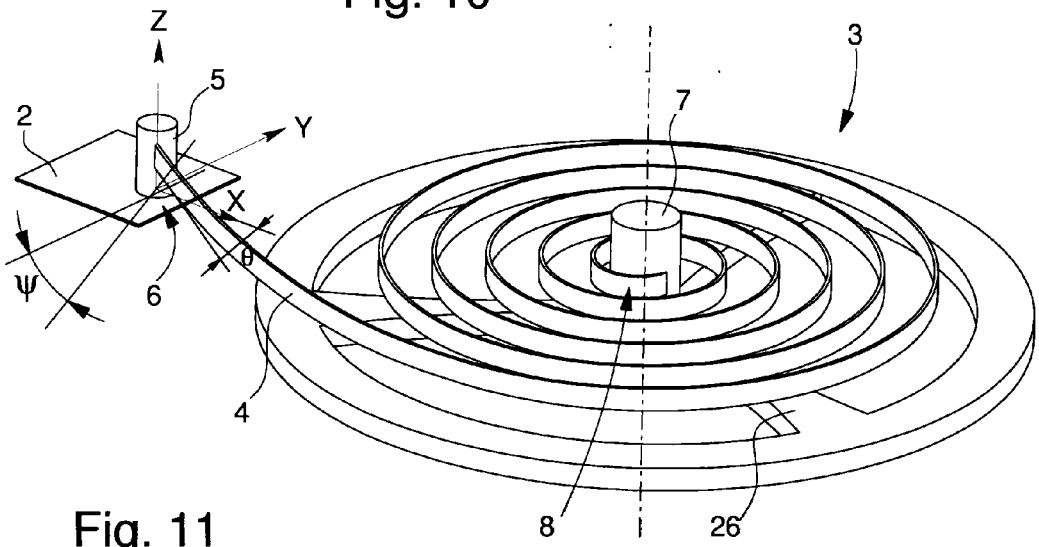
FIG. 10 shows a schematic view of a regulated parametric resonator mechanism according to the invention, comprising a timepiece sprung balance, wherein the outer coil of the balance spring is pinned to a balance spring stud to which a regulator device imparts a periodic motion, said stud being movable in a translational, pivoting and tilting motion in space to twist the balance spring if necessary.

- more specifically in a first variant of this third mode, the periodic motion imposes a periodic modulation of the point of rest of resonator mechanism 1, by modulating the equilibrium between the return forces acting on resonator mechanism 1 generated by mechanical elastic return means and/or magnetic return means and/or electrostatic return means. To modulate this equilibrium, the simplest solution is to subject the resonator to several return forces of different origin; it is sufficient to modulate at least one of the return forces in time, in intensity and/or direction. These forces are not necessarily all of the same nature, some may be mechanical (springs) and others connected to the application of a field. A specific example is the application to a sprung balance 3 provided with two springs, modulation of the position of only one of the balance spring studs is sufficient to modulate the equilibrium. Twisting a balance spring, at angle 4) of FIG. 10 is a good means of modifying the balance of forces applied to resonator 1, and thus to modulate their equilibrium. It is noted in this regard that the six degrees of freedom can be applied to the stud, the Figure showing a specific simplified application, and in particular rotation about axis Z may be advantageous:
- in a second variant of this third mode, modulation of the point of rest is combined with modulation of rigidity according to the first mode: indeed, often, if the equilibrium of forces is modified, the overall rigidity is also modified. The modulation action on the point of rest is thus combined with a modulation action on rigidity.

Preferably, when the component on which rigidity can be modulated is formed of several elements, the modulation is performed on at least one of such elements.

In another implementation mode of the invention, the periodic motion imposes a periodic modulation of the quality factor of resonator mechanism 1, and according to the invention, the periodic motion is imparted at the same regulation frequency $\omega R$ both to a component of resonator mechanism 1 and to a loss generation mechanism on at least one component of resonator mechanism 1.

In yet another implementation mode of the invention, compatible with each of the various modes presented above, regulator mechanism 2 imposes a periodic modification of the frequency of resonator mechanism 1 with a higher relative amplitude than the inverse quality factor of resonator mechanism 1.

In an easy-to-implement mode of the invention, regulator device 2 acts on at least one attachment of resonator mechanism 1.

As regards frequency $\omega R$, although it is possible to imagine that the periodic modulation of the various characteristics: resonant frequency, quality factor, point of rest, occurs for each at different multiples of frequency $\omega 0$ (for example, rigidity modulation with double the basic frequency and quality factor modulation at quadruple the basic frequency), this does not provide any particular advantage, because the maximum effect and stability of parametric amplification is obtained when the frequency is double the basic frequency. Further, it is not easy to envisage a system wherein each characteristic is modulated differently, except if there is a plurality of regulators 2, which would make the system complex. Therefore, modulation of all the parameters preferably occurs at the same frequency ωR.

Different applications of the invention are possible.

In a conventional application, the invention is applied to a resonator mechanism 1 comprising at least one elastic return means 40, and at least one such regulator device 2 is made to act by controlling a periodic variation in the frequency of resonator mechanism 1 and/or in the quality factor of resonator mechanism 1.

In a normal watchmaking application, the invention is applied to a resonator mechanism 1 comprising at least one sprung balance assembly 3 including a balance 26 with at least one spring 4 as the elastic return means 40. More specifically, as seen in FIG. 3, the inertia and quality factor of resonator mechanism 1 are modified by regulator device 2 setting in motion secondary sprung balances 260 having a high residual unbalance 261 eccentrically mounted on balance 26 and oscillating according to the speed of resonator 1.

Figure 5A:
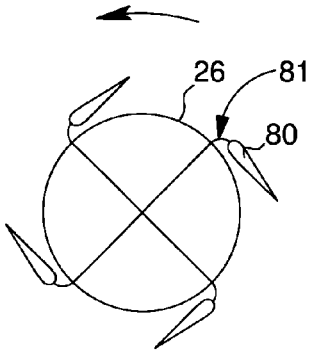
FIGS. 5A, 5B, 5C show schematic, partial plan views of a balance carrying on its rim elements that pivot during the pivoting motion of the balance.
Figure 5B:
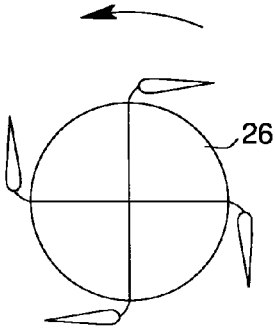
Figure 5C:
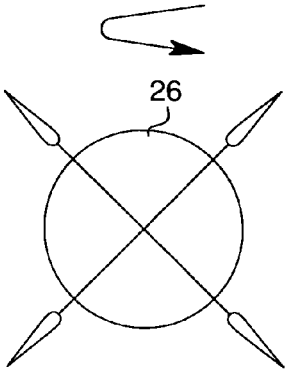

In another variant of the application to a sprung balance assembly 3 comprising a balance 26 with at least one spring 4 as elastic return means 40, the quality factor of resonator mechanism 1 is modified through modification of the air friction of balance 26, generated by a local modification of the geometry of balance 26, under the action of regulator device 2, the device is on balance 26 here. For example, as seen in FIG. 5 balance 26 may carry flaps like aircraft wings hinged at the periphery thereof, particularly by flexible guide members or similar, these flaps being preferably reversible and then able to tip completely according to the direction of motion. Preferably, these flaps are held by flexible strips. At intermediate speed, the flaps are close to the rim, in FIG. 5A. At maximum speed in FIG. 5B, an aerodynamic effect lifts them up (aircraft wing effect), when the flaps change to the other side as seen in FIG. 5C. In this example, the inertia is modified with a frequency that is 4 times the natural frequency of the sprung balance resonator. Air friction of the aerobraking type is thus obtained, with a flap at the periphery of the balance having an influence on the quality factor and/or inertia. This flap may be loosely pivotally mounted or pivotally mounted and returned by a balance spring or flexible guide member or similar. One variant may consists of a balance rim of variable geometry. Thus, in such a variant, the quality factor of resonator mechanism 1 is modified through modification of the air friction of balance 26 generated by a local modification of the geometry of balance 26 under the action of regulator device 2. It will be noted that regulator 2 can move independently of the speed of resonator 1. A specific variant consists in combining this variant with the preceding variant where eccentric sprung balances 260 are set in oscillation.

In another variant where the environment is acted upon rather than the actual balance, the quality factor of resonator mechanism 1 is modified through a modification of the air friction of balance 26 generated by a local modification of the geometry of the environment around balance 26 under the action of regulator device 2 as seen in FIG. 6 where a pad moved by a periodic motion modifies the flow of air around the balance.

The invention is therefore also applicable to resonator mechanisms 1 with no mechanical return means. Thus, in specific applications (not shown), the periodic motion of regulator mechanism 2 imposes modulation of the frequency and/or quality factor and/or point of rest of resonator mechanism 1 via a remote electrical or magnetic or electromagnetic force.

Figure 9:
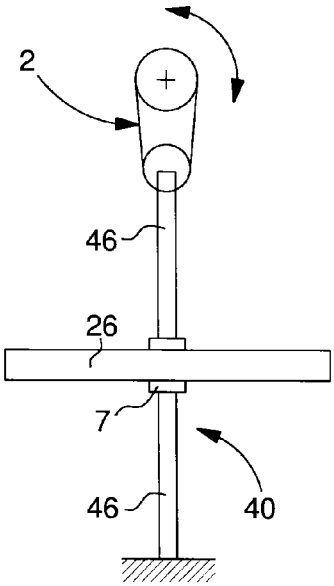
FIG. 9 illustrates a resonator mechanism comprising a balance including a collet holding a torsion wire, wherein a resonator device controls a periodic variation in tension with a frequency double that of the balance and torsion wire resonator.

Another variant application of the invention, seen in FIG. 9, concerns a resonator mechanism 1 comprising at least one balance 26 comprising a collet 7 holding a torsion wire 46 which forms elastic return means 40 where at least one regulator device 2 is made to act by controlling a periodic variation in the tension of torsion wire 46. In a similar variant, the torsion wire is replaced by a flexible guide member.

Another variant application of the invention, seen in FIG. 8, concerns a resonator mechanism 1 comprising at least one tuning fork, wherein at least one regulator device 2 is made to act by controlling a periodic variation in the frequency of resonator mechanism 1 and/or in the rigidity of at least one tuning fork arm defining the quality factor of resonator mechanism 1. More specifically, regulator device 2 can act on the attachment of the tuning fork, and/or on a wheel set exerting pressure on at least one arm of the tuning fork. It will be noted that this type of tuning fork is not necessarily in the conventional shape of a fork, and may take, among other possible shapes, a heart-shape or H-shape.

In a variant, the invention is also applicable to a resonator with a single arm, or to a resonator operating in torsion, or in elongation.

Advantageously, the invention makes it possible to use regulator device 2 to start and/or to maintain resonator mechanism 1. Preferably, this regulator device 2 cooperates with a start and/or maintenance mechanism of resonator mechanism 1 to increase the oscillation amplitude of resonator mechanism 1.

The invention advantageously makes co-maintenance possible: standard low-power maintenance, combined with the parametric method for maintaining oscillation. Regulator device 2 is used for the continuous maintenance of resonator mechanism 1, alone or in cooperation with a start and/or impulse maintenance mechanism.

Figure 15:
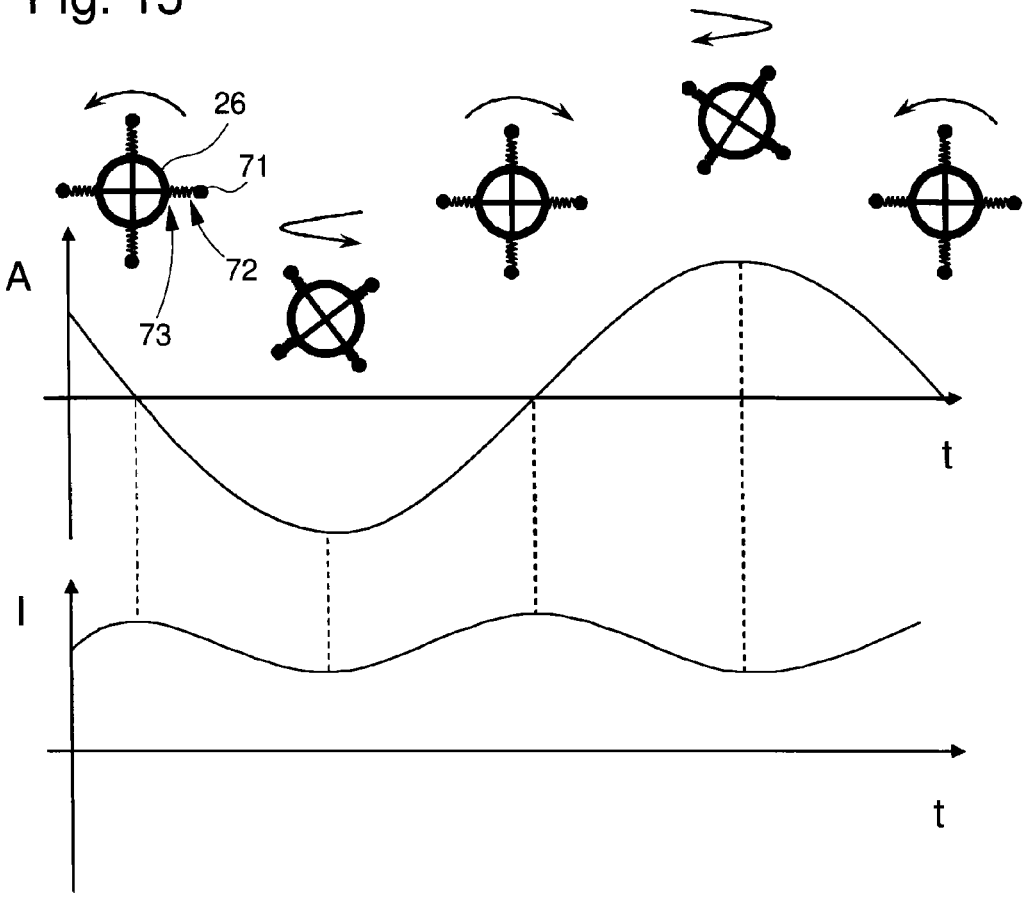
FIG. 15 illustrates the regulation obtained with a resonator of the type shown in FIG. 2.

For example, such maintenance can be obtained with a sprung balance system, comprising a balance including on its rim springs carrying oscillating inertia blocks, according to the configuration of FIG. 2. A lever escapement or similar then makes it possible to excite the oscillations of the balance and the small inertia blocks. The springs and inertia blocks oscillate at a frequency, here double the natural frequency of the sprung balance. The inertia blocks oscillate by inertial coupling. The parametric effect occurs, because the inertia of the balance varies at a frequency double that of the sprung balance. FIG. 15 illustrates regulation obtained with a resonator of this type. It is to be noted that in this case, the aerodynamic losses are also modified.

Another example consists in using a detent escapement, which also ensures the counting function, in cooperation with a regulator mechanism 2 acting on the rigidity of balance spring 4 (with pins that move).

The invention also concerns a timepiece movement 10 including at least one such resonator mechanism 1. According to the invention, this movement 10 comprises at least one such regulator device 2, arranged to act on resonator mechanism 1, by imposing a periodic modulation of one or more physical characteristics of resonator mechanism 1: resonant frequency and/or quality factor and/or point of rest, with a regulation frequency ωR which is comprised between 0.9 times and 1.1 times the value of a multiple integer of the natural frequency ω0 of resonator mechanism 1, said integer being greater than or equal to 2.

In a variant, this regulator device 2 is arranged to act on resonator mechanism 1 by directly imparting a periodic motion thereto with regulation frequency ωR.

In a variant, this regulator device 2 acts on at least one attachment of resonator mechanism 1 and/or the frequency, particularly on rigidity and/or inertia, of resonator mechanism, and/or on the quality factor of resonator mechanism 1, and/or on the losses or friction of resonator mechanism 1.

In a variant, regulator device 2 acts on resonator mechanism 1 by imparting the periodic motion to a component of resonator mechanism 1 and/or to a loss generation mechanism on at least one component of resonator mechanism 1.

The invention also concerns a timepiece 30 including at least one such timepiece movement 10.

The few parametric oscillator examples illustrated here are non-limiting. Some, like those of FIGS. 15 to 18, may be inserted straight into existing movements, replacing standard components such as balances, which is an advantages, since the design and manufacture of the mechanical components of the movement concerned are not called into question.

One of the advantages of these systems is that it is possible to operate a sprung balance at a high frequency, despite the inherent decrease in the efficiency of the escapement.

The easiest principle to implement consists in making one part of the balance oscillate. These oscillations (at a frequency multiple n≥2 of the natural frequency of the sprung balance) either modify the inertia or the centre of gravity or aerodynamic losses.

The Figures illustrate simple, non-limiting examples of embodiments of the invention. Some may be very simply implemented, for example by substituting a particular balance for a standard balance.

These examples show that the constituents of regulator 2 may be built into some components of resonator 1. In numerous cases, the invention does not require a secondary excitation circuit, it is the dimensions of the regulator components which enable it to oscillate at a defined frequency ωR in its specific relation to the natural frequency ω0 of resonator 1.

FIG. 1 shows a parametric resonator mechanism 1 regulated according to the invention, comprising a sprung balance 3 with a balance 26 and a balance spring (not shown), forming a resonator. The inertia and/or the quality factor is modulated by inertia blocks 71 arranged radially or tangentially via springs 72, the latter are fixed at points of attachment 73 to the structure of balance 26, in particular to its rim. These inertia block-spring assemblies are excited at a frequency double the frequency ω0 of resonator 1 with sprung balance 3. Resonator 1 carries here the elements of regulator 2 formed by the inertia block-spring assemblies, which vibrate radially and/or tangentially during the pivoting motion of balance 26. Some may, in particular, be guided in a path 74 comprised in balance 26. The radial vibration of the inertia blocks affects the inertia and friction term, the tangential vibration affects the dynamic inertia. Balance 26 also carries here arms 85 carrying vibrating strips 84 which oscillate mainly radially. For regulator 2 to be highly efficient, springs 72 are preferably of large volume in comparison to the balance, their radial footprint is, for example, on the order of the radius of the rim of the actual balance, or greater with for example a radial footprint of spring 72 and inertia block 71 equivalent to quadruple the radius of a collet 7.

Preferably, and this is true for all the examples, all the vibrating assemblies comprised in the regulator oscillate at the same frequency ωR defined by the invention. It is also acceptable for some of them to oscillate at frequency that is an integer multiple of frequency ωR defined by the invention relative to natural frequency ω0.

FIG. 2 also shows a resonator 1 with a sprung balance 3, whose balance 26 carries the elements of regulator 2: four radial springs 72 attached to the rim at points 73 and carrying inertia blocks 71 and subjected to regulation excitation at a frequency double the frequency ω0 of resonator 1. FIG. 15 illustrates regulation obtained with a resonator of this type.

FIG. 3 shows a very easy solution for replacing an existing balance, with a resonator 1 similar to those of FIGS. 1 and 2, comprising a balance 26 carrying loosely pivotally mounted secondary in-built sprung balances 260 each having a high unbalance 261. There are two embodiments:

- either the secondary sprung balances 260 are entirely free to rotate, with no amplitude limitation, for example with conventional mechanical pivoting;
- or the secondary sprung balances 260 are limited in amplitude, and are, for example, made in one-piece with balance 26 in a silicon or similar embodiment, with a flexible pivot and thus limited amplitude.

FIG. 4 shows a similar resonator 1 to those of the preceding Figures, with a balance 26 suspended from one or more structures 50 by two diametrically opposite, substantially radial springs 51, the trajectory of the centre of gravity of balance 26 corresponding to the common direction of these two springs 51. In a variant, the balance staff is held by springs. In another variant, balance 26 is not pivoted with a conventional arbor, but only with flexible guide members; the virtual balance staff is then defined by the direction of the springs. The Figure is deliberately simplified with only two springs; it is naturally possible to envisage suspending balance 26 from, three or more springs 51. A one-piece embodiment of this entire assembly is possible, within the limits of the desired pivoting amplitude of balance 26. It is clear that a multi-level embodiment is possible, to distribute the functional components on different planes.

FIGS. 5A, 5B, 5C show another similar resonator 1 incorporating a balance 26 carrying on its rim flaps 60 with an aerodynamic profile, hinged on flexible pivots 81 on the rim of balance 26 and which pivot during the pivoting motion of balance 26, as explained above. This configuration can operate in a vacuum with a flap regulation frequency double the natural frequency ω0, or in the air, with a frequency four times ω0.

FIG. 6 shows a resonator 1 with a balance 26. Here regulator 2 is completely separate from resonator 1: a pad 82 in proximity to the rim of balance 26 forms an aerodynamic brake, is suspended by a spring 83 from a structure 53 and is movable at a frequency double that of the sprung balance resonator 1 incorporating the balance. This mobility may result from an external excitation source, it may also result from a profile, for example a toothed profile, of the balance rim, which creates a variation in the air flow in proximity to pad 82.

FIG. 7 shows a similar balance to that of FIG. 3 with two secondary sprung balances 260 with high unbalances 261, loosely mounted on the same diameter and in a position of alignment of the unbalances (at the point of rest), which are different from those of FIG. 3 and either in-phase or in anti-phase vibration. Preferably, this embodiment is made of silicon or another similar micromachinable material (especially silicon oxide, quartz, "LIGA"®, amorphous metal, or suchlike): the secondary sprung balances and their unbalances 261 are in one-piece with balance 26 relative to which they pivot via flexible connections, and alignment of the unbalances is the rest state of this structure. This type of balance is also a very easy solution for replacing an existing balance to improve chronometric performance.

FIG. 8 shows a resonator 1 with a tuning fork 55, fixed to a structure 50, and one arm 56 of which is in contact with a friction pad 57 excited at a frequency double the frequency of the tuning fork resonator.

FIG. 9 illustrates a resonator mechanism comprising a balance 26 including a collet 7 holding a torsion wire 46, wherein a resonator device 2 controls a periodic variation in tension with a frequency double that of the balance and torsion wire resonator 1.

FIG. 10 shows a parametric resonator mechanism 1 comprising a sprung balance 3, wherein the outer coil 6 of the balance spring 4 is pinned to a balance spring stud 5 to which a regulator device 2 imparts a periodic motion, said stud 5 being movable in a translational, pivoting and tilting motion in space to twist balance spring 4 if necessary.

FIG. 11 shows another sprung balance 3 resonator 1 with a balance spring 4 provided with an index mechanism with an index 12 and pins 11, with a regulator system 2 with a crank rod system for actuating a continuous motion of index 12, for a continuous variation in the active length of balance spring 4.

FIG. 12 shows, in a similar manner, a balance spring 4 on which a cam 14 rests, driven in rotation by a regulator 2 for a continuous variation in the active length of balance spring 4 and/or in the position of the point of attachment and/or in the geometry of the balance spring. This Figure is a simplified representation wherein a single cam rests on the balance spring on only one side; it is evidently possible to combine two cams arranged to clamp balance spring 4 on both sides.

FIG. 13 shows, in a similar manner, a balance spring 4 with an additional coil 18 fixed to the balance-spring and locally lining the terminal curve 17 of the balance spring, and a regulator device 2 actuating one end 18A of this additional coil 18.

FIG. 14 illustrates another balance spring 4 with, in proximity to its terminal curve 17, another coil 23 which is held at a first end 24 by a support 59 operated by a regulator device 2, and which is free at a second end 25 arranged to periodically come into contact with terminal curve 17 under the action of regulator device 2 on this support.

FIGS. 16A and 16B illustrate modification of the centre of gravity of resonator 1, with a sprung balance 3 resonator comprising a balance 26 carrying substantially radial springs 72 attached to the rim and carrying oscillating inertia blocks 71, similar to FIG. 2 but some towards the interior and some towards the exterior of the rim. The associated centripetal or centrifugal effects allow for modulation of the position of the centre of gravity of resonator 1.

Figure 17A:
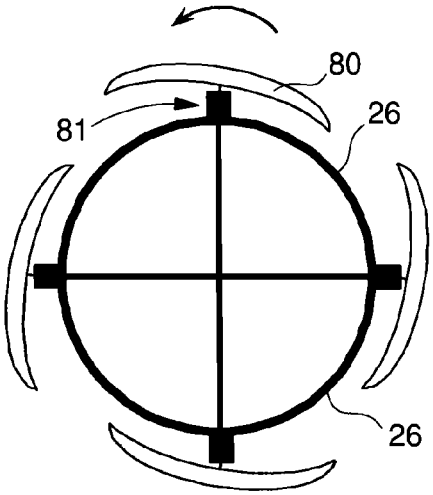
FIGS. 17A and 17B illustrate, in a similar manner to FIG. 5, another balance system having wings with a flexible pivot making it possible to modify aerodynamic losses and inertia.
Figure 17B:
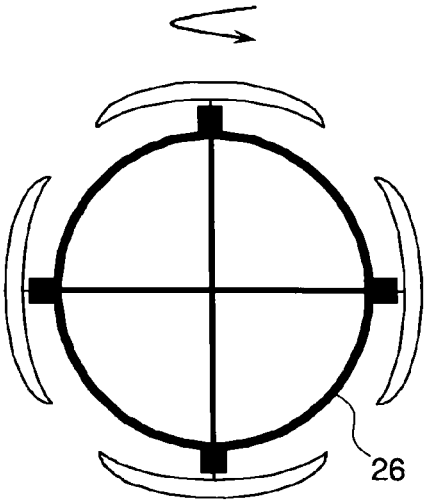
Figure 18A:
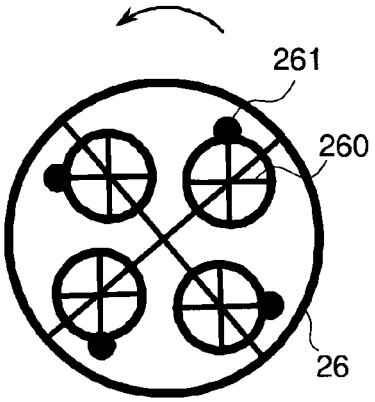
FIGS. 18A to 18D illustrate modulation of the centre of gravity, based on a resonator like that of FIG. 3 or FIG. 7, comprising built-in sprung balances.
Figure 18B:
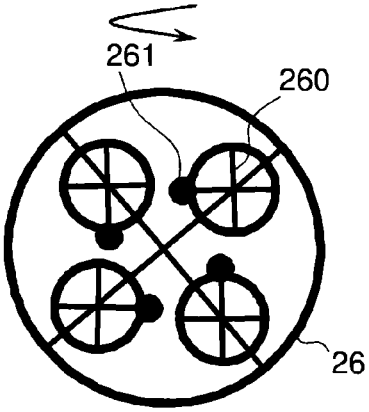
Figure 18C:
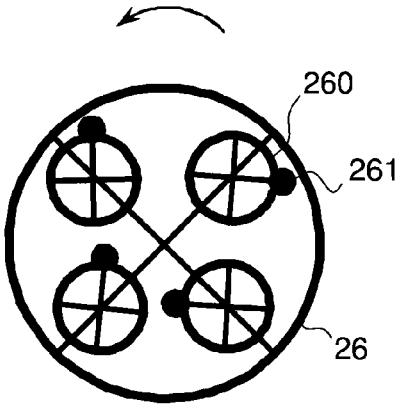
Figure 18D:
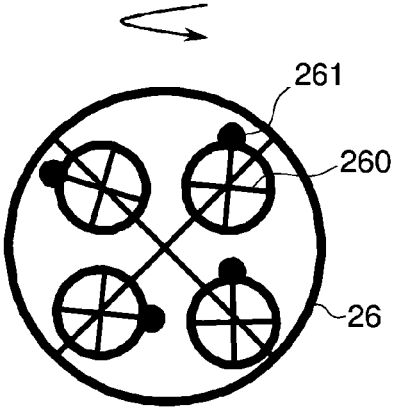

FIGS. 17A and 17B illustrate, in a similar manner to FIG. 5, another variant balance system 26 having flaps 80 with a flexible pivot 81 for modifying aerodynamic losses and inertia.

FIGS. 18A to 18D illustrate modulation of the centre of gravity, based on a resonator like that of FIG. 3 or FIG. 7, comprising built-in secondary sprung balances 260 with unbalances 261.

Figure 19:
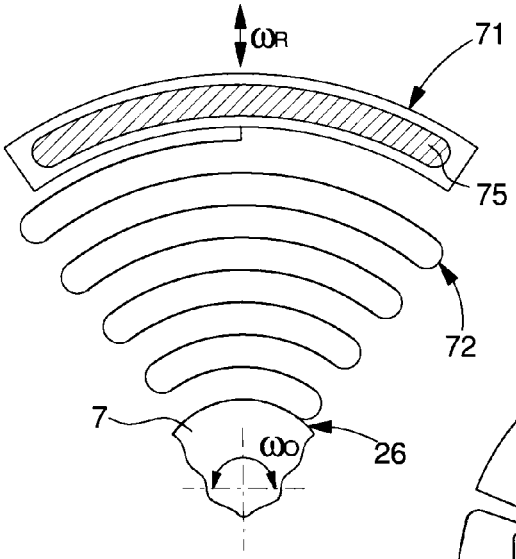
FIG. 19 illustrates an example embodiment of a parametric oscillator with a balance collet carrying a silicon spring bearing a peripheral inertia block weighted with a gold layer, the spring-inertia block assembly oscillating at a regulation frequency $\omega R$.
Figure 20:
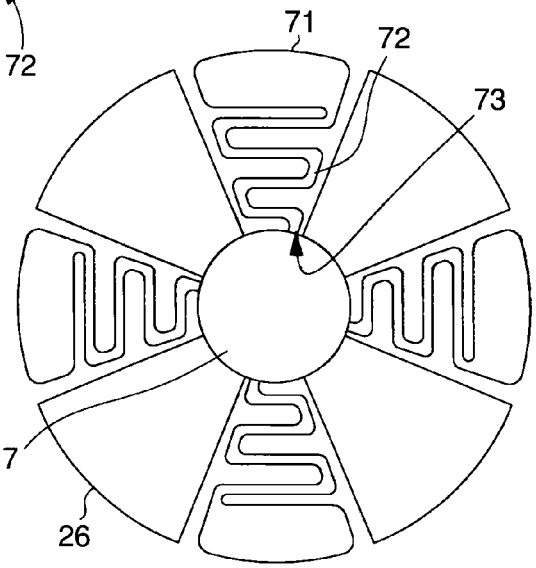
FIG. 20 shows a balance comprising spring-inertia blocks assemblies similar to that of FIG. 19.

FIG. 19 illustrates an example embodiment of a parametric oscillator with a balance collet 7 carrying a silicon spring 72 bearing a peripheral inertia block 71 weighted with a layer 75 of gold or another heavy metal obtained, for example, by galvanic deposition or other means, the spring-inertia block assembly oscillating at a regulation frequency ωR. For example, ω0=10 Hz and ωR=20 Hz. FIG. 20 shows a balance 26 where these spring-inertia block assemblies extend from collet 7 to the largest diameter of the rim.

Figure 21:
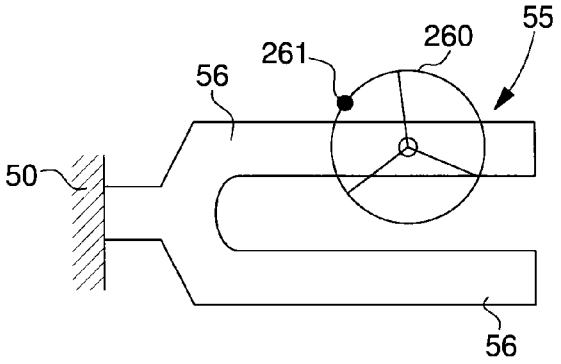
FIG. 21 shows a tuning fork whose branch carries a loosely pivotally mounted secondary sprung balance.
Figure 23:
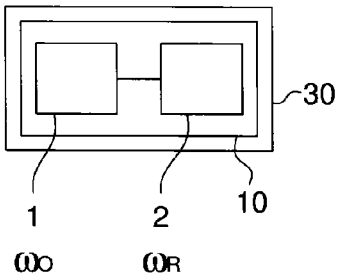
FIG. 23 shows a block diagram of a watch including a mechanical movement with a resonator mechanism regulated according to the invention by a double frequency regulator device.

FIG. 21 shows a tuning fork 55 built into a support 50 and wherein one branch 56 carries a secondary sprung balance assembly 260 with eccentric unbalance 261 loosely pivotally mounted on branch 56.

Figure 22:
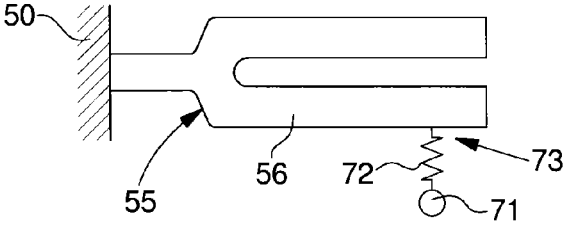
FIG. 22 shows a tuning fork whose branch carries a spring-inertia block assembly mounted to vibrate freely.

FIG. 22 shows a tuning fork 55 one branch 56 of which carries a spring 72-inertia block 71 assembly mounted to vibrate freely.

The invention also concerns, in an advantageous embodiment, a timepiece resonator mechanism 1 with forced oscillation, arranged to oscillate at a natural frequency ω0, and comprising, on the one hand, at least one oscillating member 100, which preferably includes a balance 26 or a tuning fork 55 or a vibrating strip, or similar, and on the other hand, oscillation maintenance means 200 arranged to exert an impact and/or a force and/or a torque on said oscillating member 100.

According to the invention, this oscillating member 100 carries at least one oscillating regulator device 2 whose natural frequency is a regulation frequency ωR which is comprised between 0.9 times and 1.1 times the value of an integer multiple of the natural frequency ω0 of said resonator mechanism 1, this integer being greater than or equal to 2. The specific values of ωR relative to natural frequency ω0 preferably follow the specific rules set out above.

In a first variant, this regulator device 2 includes at least one secondary sprung balance 260 pivoting about a secondary pivot axis, with an eccentric unbalance 261 relative to said secondary pivot axis of said secondary sprung balance 260, which is loosely pivotally mounted on oscillating member 100.

Specifically, oscillating member 100 pivots about a main pivot axis, and this at least one secondary sprung balance 260 has an eccentric secondary axis relative to the main pivot axis.

In a specific embodiment, regulator device 2 includes at least a first secondary sprung balance 260 and a second secondary sprung balance 260 whose unbalances 261, in a rest state with no stress, are aligned with the secondary pivot axes of secondary sprung balances 260. More specifically, oscillating member 100 pivots about a main pivot axis, and at least one said secondary sprung balance 260 has an eccentric secondary axis relative to the main pivot axis.

In an advantageous embodiment allowed by micromaterial technology, at least one such secondary sprung balance 260 pivots about a virtual secondary axis defined by elastic maintenance means comprised in oscillating member 100 for holding secondary sprung balance 260 and its amplitude of motion is limited relative to oscillating member 100

Advantageously, at least one such secondary sprung balance 260 is in one-piece with oscillating member 100.

More specifically, at least one said secondary sprung balance 260 is in one-piece with a balance 26 comprised in oscillating member 100, or which forms said oscillating member 100.

In a second variant, regulator device 2 includes at least one spring-inertia block assembly comprising an inertia block 71 attached by a spring 72 at a point 73 on oscillating member 100.

Specifically, oscillating member 100 pivots about a main pivot axis, and at least one such spring 72 extends radially relative to said main pivot axis.

In a specific embodiment, oscillating member 100 carries several such spring-inertia block assemblies, whose springs 72 extend radially relative to the main pivot axis, and wherein at least one assembly carries its inertia block 71 further from the main pivot axis than its spring 72 and wherein at least another assembly carries its inertia block 71 closer to the main pivot axis than its spring 72.

Specifically, oscillating member 100 pivots about a main pivot axis, and at least one such spring 72 extends in a direction tangential to point 73 relative to the main pivot axis.

Specifically, at least one such spring-inertia block assembly is free to move relative to oscillating member 100, except for its point of attachment 73.

In a specific embodiment, the mobility of the spring-inertia block assembly is limited by guide means comprised in said oscillating member 100, or travels in a path 74 comprised in said oscillating member 100.

In a third variant, regulator device 2 includes at least one flap 80 or a strip 84 that is movable under the effect of aerodynamic variations and attached by a pivot 81 or by an elastic strip or by an arm 85 to oscillating member 100.

In particular, in a specific embodiment, at least one flap 80 or strip 84 can tilt relative to pivot 81 or to the elastic strip or to arm 85 by which it is carried.

In an advantageous embodiment which allows for easy adaptation of the invention to existing movements, making it possible to considerably improve their chronometric performance at minimum cost, oscillating member 100 is a balance 26 subjected to the action of oscillation maintenance means 200, which are return means comprising at least one balance spring 4 and/or at least one torsion wire 46.

In another specific embodiment, oscillating member 100 is a tuning fork 55 of which at least one branch 56 is subjected to the action of oscillation maintenance means 200.

It is clear that these different, non-limiting variants may be combined with each other and/or with yet other variants observing the principles of the invention.

The invention also concerns a timepiece movement 10 comprising at least one resonator mechanism 1 arranged to oscillate around its natural frequency ω0. According to the invention, this movement 10 includes at least one regulator device 2 comprising means arranged to act on said resonator mechanism 1 by imposing a periodic modulation of the resonant frequency and/or quality factor and/or point of rest of resonator mechanism 1, with a regulation frequency ωR which is comprised between 0.9 times and 1.1 times the value of an integer multiple of the natural frequency ω0 of said resonator mechanism 1, this integer being greater than or equal to 2 and less than or equal to 10.

In a first variant, this movement 10 includes at least one such resonator mechanism 1, whose oscillating member 100 carries at least one said regulator device 2.

In a second variant, movement 10 includes at least one said regulator device 2 distinct from a said at least one resonator mechanism 1, and which acts either by contact with at least one component of said resonator mechanism 1, or remote from said resonator mechanism 1 through modulation of an aerodynamic flow or of a magnetic field or of an electrostatic field or of an electromagnetic field.

Advantageously, this resonator mechanism 1 includes at least one deformable component of variable rigidity and/or inertia, and said at least one regulator device 2 includes means arranged to deform the deformable component to vary its rigidity and/or inertia.

In a specific embodiment, this at least one regulator device 2 includes means arranged to deform resonator mechanism 1 and to modulate the position of the centre of gravity of resonator mechanism 1.

In a specific embodiment, this at least one regulator device 2 includes loss generation means in at least one component of said resonator mechanism 1.

In an embodiment that is advantageous since it is very easy to implement, regulator device 2 includes means for modulating an aerodynamic flow in proximity to oscillating member 100, these modulation means comprising at least one pad 83 suspended from a structure 50 by elastic return means 83.

The invention also concerns a timepiece 30 particularly a watch, including at least one such timepiece movement 10.

Naturally, it is perfectly possible to apply the invention to another timepiece such as a clock. It is applicable to any type of oscillator comprising a mechanical oscillating member 100, and particularly to a pendulum.

Excitation at frequency ωR as defined above, and more particularly at double the frequency ω0, may be achieved with a square or pulsed signal; it is not essential to have sinusoidal excitation.

The maintenance regulator does not need to be very accurate: any lack of accuracy results only in a loss of amplitude, but with no frequency variation unless of course the frequency is very variable, which is to be avoided. In fact, these two oscillators, the regulator that maintains and the maintained resonator, are not coupled, but one maintains the other, ideally (but not necessarily) in a single direction.

In a preferred embodiment, there is no coupling spring between maintenance regulator 2 and maintained resonator 1.

The invention also differs from known coupled oscillators in that the frequency of the regulator is double or a multiple of the natural frequency of the resonator (or at least very close to a multiple), and in the mode of energy transfer.

What is claimed is:

1. A forced oscillation timepiece resonator mechanism arranged to oscillate at a natural frequency and comprising, on the one hand, at least one oscillating member, and on the other hand, means for maintaining oscillations arranged to exert an impact and/or a force and/or a torque on said oscillating member, wherein said oscillating member carries at least one oscillating regulator device whose natural frequency is a regulation frequency that is comprised between 0.9 times and 1.1 times a value of an integer multiple of the natural frequency of said resonator mechanism, said integer being greater than or equal to 2 and less than or equal to 10, wherein said regulator device includes, loosely pivotally mounted on said oscillating member, at least one secondary sprung balance with an eccentric unbalance relative to a secondary pivot axis about which said secondary sprung balance pivots.

2. A resonator mechanism according to claim 1, wherein said oscillating member pivots about a main pivot axis, and in that said at least one secondary sprung balance pivots about an eccentric secondary pivot axis relative to said main pivot axis.

3. The resonator mechanism according to claim 1, wherein said regulator device includes at least a first secondary sprung balance and a second secondary sprung balance whose said unbalances, in a rest state with no stress, are aligned with the secondary pivot axes about which said secondary sprung balances pivot.

4. The resonator mechanism according to claim 3, wherein said oscillating member pivots about a main pivot axis, and in that said at least one secondary sprung balance pivots about an eccentric secondary pivot axis relative to said main pivot axis.

5. The resonator mechanism according to claim 1, wherein at least one said secondary sprung balance pivots about a virtual secondary axis defined by elastic holding means comprised in said oscillating member for holding said secondary sprung balance, and an amplitude of motion thereof is limited relative to said oscillating member.

6. The resonator mechanism according to claim 1, wherein at least one said secondary sprung balance is in one-piece with said oscillating member.

7. The resonator mechanism according to claim 1, wherein at least one said secondary sprung balance is in one-piece with a balance comprised in said oscillating member.

8. The resonator mechanism according to claim 1, wherein said regulator device includes at least one spring-inertia block assembly comprising an inertia block attached by a spring at a point on said oscillating member.

9. The resonator mechanism according to claim 8, wherein said oscillating member pivots about a main pivot axis, and in that said at least one said spring extends radially relative to said main pivot axis.

10. The resonator mechanism according to claim 9, wherein said oscillating member carries several said spring-inertia block assemblies wherein said springs extend radially relative to said pivot axis, and wherein at least one assembly carries its inertia block further from said pivot axis than its spring, and wherein at least one assembly carries its inertia block closer to said pivot axis than its spring.

11. The resonator mechanism according to claim 8, wherein said oscillating member pivots about a main pivot axis, and in that said at least one said spring extends in a tangential direction to said point relative to said main pivot axis.

12. The resonator mechanism according to claim 8, wherein at least one said spring-inertia block assembly is free to move relative to said oscillating member, except for a point of attachment to the spring-inertia block assembly.

13. The resonator mechanism according to claim 8, wherein at least one said spring-inertia block assembly is movable in a manner limited by guide means comprised in said oscillating member, or travels in a path comprised in said oscillating member.

14. The resonator mechanism according to claim 1, wherein said regulator device includes at least one flap or one strip that is movable under the effect of aerodynamic variations and attached by a pivot or by an elastic strip or by an arm to said oscillating member.

15. The resonator mechanism according to claim 14, wherein said at least one flap or strip can tilt relative to said pivot or to said elastic strip or to said arm which carries said flap or strip.

16. The resonator mechanism according to claim 1, wherein said oscillating member includes a balance or a tuning fork or a vibrating strip.

17. The resonator mechanism according to claim 1, wherein said oscillating member is a balance subjected to an action of an oscillation maintenance means, which are return means comprising at least one balance spring and/or at least one torsion wire.

18. The resonator mechanism according to claim 1, wherein said oscillating member is a tuning fork at least one branch of which is subjected to an action of an oscillation maintenance means.

19. A timepiece movement comprising at least one resonator mechanism according to claim 1, wherein said oscillating member carries at least one said regulator device.

20. The timepiece movement according to claim 19, wherein said movement includes at least one said regulator device distinct from a said at least one resonator mechanism, and which acts either by contact with at least one component of said resonator mechanism, or remote from said resonator mechanism through modulation of an aerodynamic flow or of a magnetic field or of an electrostatic field or of an electromagnetic field.

21. The timepiece movement according to claim 19, wherein said resonator mechanism includes at least one deformable component of variable rigidity and/or inertia, and in that said at least one regulator device includes means arranged to deform said deformable component to vary the rigidity and/or inertia thereof.

22. The timepiece movement according to claim 19, wherein said at least one regulator device includes means arranged to deform said resonator mechanism and to modulate a position of the centre of gravity of said resonator mechanism.

23. The timepiece movement according to claim 19, wherein said at least one regulator device includes loss generation means in at least one component of said resonator mechanism.

24. The timepiece movement according to claim 19, wherein said at least one regulator device includes means for modulating an aerodynamic flow in proximity to said oscillating member comprising at least one pad suspended from a structure by elastic return means.

25. A timepiece, particularly a watch, including at least one timepiece movement according to claim 19.

* * * * *